US005801360A

United States Patent [19]

Oba et al.

[11] Patent Number: 5,801,360

[45] Date of Patent: Sep. 1, 1998

[54] IMAGE FIXING APPARATUS

[75] Inventors: Hiroyuki Oba; Yasumasa Ohtsuka; Kouichi Okuda; Tatsunori Ishiyama, all of Yokohama; Akira Hayakawa; Daizo Fukuzawa, both of Tokyo; Takashi Shibuya, Kawasaki, all of Japan

[73] Assignee: Canon Kabushiki Kaisha, Tokyo, Japan

[21] Appl. No.: 539,739

[22] Filed: Oct. 5, 1995

[30] Foreign Application Priority Data

Oct. 5, 1994 [JP] Japan ..... 6-264383
Nov. 30, 1994 [JP] Japan ..... 6-296676

[51] Int. Cl.[6] ..... G03G 15/20

[52] U.S. Cl. ..... 219/216; 399/69; 399/70; 399/329

[58] Field of Search ..... 219/216, 469–471, 219/494; 399/330, 332, 335, 338, 69, 70; 432/60, 228; 492/46

[56] References Cited

U.S. PATENT DOCUMENTS 5,149,941 9/1992 Hirabayashi et al. .
5,262,834 11/1993 Kusaka et al. .
5,365,314 11/1994 Okuda et al. .
5,444,521 8/1995 Tomoyuki et al. .
5,464,964 11/1995 Okuda et al. .
5,534,987 7/1996 Ohtsuka et al. ..... 219/216
5,541,719 7/1996 Tamaki ..... 219/216
5,572,306 11/1996 Goto et al. ..... 219/216

FOREIGN PATENT DOCUMENTS 58-72978 5/1983 Japan .
60-31172 2/1985 Japan .

*Primary Examiner*—John A. Jeffery
*Assistant Examiner*—J. Pelham
*Attorney, Agent, or Firm*—Fitzpatrick, Cella, Harper & Scinto

[57] ABSTRACT

A fixing apparatus includes a heat generating element for generating heat upon electric power supply thereto; a temperature detecting element a for detecting a temperature or the heat generating element; power application control for controlling the power to the heat generating element so that the temperature detected by the temperature detecting element maintains a fixing temperature; and a power setting device for pre-applying power to the heat generating element to detect a rate of temperature change during the pre-application of power, before power is applied to start up the heat generating element to the fixing temperature, and for setting the power to be applied during the start-up period, in accordance with the detected rate of temperature change.

6 Claims, 10 Drawing Sheets

(a)

(b)

| TIME | RISING SPEED | POWER SUPPLY RATIO |
|---|---|---|
| >100msec | <100°C/sec | 100% |
| 85~100msec | 100~118°C/sec | 90% |
| 70~85msec | 118~143°C/sec | 75% |
| <70msec | >143°C/sec | 60% |

| HTR TEMP BEFOR EREGIZATION \ TEMP. RISING RATE | < 20 deg/sec | ≧ 20 deg/sec < 25 deg/sec | ≧ 25 deg/sec < 30 deg/sec | ≧ 30 deg/sec < 35 deg/sec | ≧ 35 deg/sec < 40 deg/sec | ≧ 40 deg/sec < 45 deg/sec | ≧ 45 deg/sec |
|---|---|---|---|---|---|---|---|
| ≧100°C | 14/14 WAVES | 14/14 WAVES | 14/14 WAVES | 7/14 WAVES | 7/14 WAVES | 7/14 WAVES | 7/14 WAVES |
| ≧ 70°C < 100°C | 14/14 WAVES | 14/14 WAVES | 12/14 WAVES | 10/14 WAVES | 8/14 WAVES | 6/14 WAVES | 5/14 WAVES |
| ≧40°C < 70°C | 14/14 WAVES | 13/14 WAVES | 11/14 WAVES | 9/14 WAVES | 8/14 WAVES | 6/14 WAVES | 5/14 WAVES |
| ≧10°C < 40°C | 14/14 WAVES | 11/14 WAVES | 9/14 WAVES | 8/14 WAVES | 7/14 WAVES | 6/14 WAVES | 5/14 WAVES |
| < 10°C | 14/14 WAVES | 10/14 WAVES | 8/14 WAVES | 7/14 WAVES | 6/14 WAVES | 5/14 WAVES | 4/14 WAVES |

FIG. 1

| HTR TEMP BEFOR EREGIZATION \ TEMP. RISING RATE | < 20 deg/sec | ≧ 20 deg/sec < 25 deg/sec | ≧ 25 deg/sec < 30 deg/sec | ≧ 30 deg/sec < 35 deg/sec | ≧ 35 deg/sec < 40 deg/sec | ≧ 40 deg/sec < 45 deg/sec | ≧ 45 deg/sec |
|---|---|---|---|---|---|---|---|
| ≧100°C | 8/14 WAVES | 8/14 WAVES | 7/14 WAVES | 6/14 WAVES | 5/14 WAVES | 4/14 WAVES | 3/14 WAVES |
| ≧ 70°C < 100°C | 8/14 WAVES | 7/14 WAVES | 6/14 WAVES | 5/14 WAVES | 4/14 WAVES | 3/14 WAVES | 3/14 WAVES |
| ≧40°C < 70°C | 7/14 WAVES | 6/14 WAVES | 5/14 WAVES | 4/14 WAVES | 4/14 WAVES | 3/14 WAVES | 2/14 WAVES |
| ≧10°C < 40°C | 7/14 WAVES | 6/14 WAVES | 5/14 WAVES | 4/14 WAVES | 3/14 WAVES | 3/14 WAVES | 2/14 WAVES |
| <10°C | 7/14 WAVES | 6/14 WAVES | 5/14 WAVES | 4/14 WAVES | 3/14 WAVES | 2/14 WAVES | 2/14 WAVES |

FIG. 2

| HTR TEMP BEFOR EREGIZATION \ TEMP. RISING RATE | < 20 deg/sec | ≧ 20 deg/sec < 25 deg/sec | ≧ 25 deg/sec < 30 deg/sec | ≧ 30 deg/sec < 35 deg/sec | ≧ 35 deg/sec < 40 deg/sec | ≧ 40 deg/sec < 45 deg/sec | ≧ 45 deg/sec |
|---|---|---|---|---|---|---|---|
| ≧110°C | 170°C TRGT | 160°C TRGT | 160°C TRGT | 160°C TRGT | 160°C TRGT | 160°C TRGT | 160°C TRGT |
| ≧ 80°C <110°C | 180°C TRGT | 170°C TRGT | 170°C TRGT | 170°C TRGT | 160°C TRGT | 160°C TRGT | 160°C TRGT |
| ≧ 50°C < 80°C | 180°C TRGT | 180°C TRGT | 180°C TRGT | 170°C TRGT | 170°C TRGT | 170°C TRGT | 170°C TRGT |
| ≧ 20°C < 50°C | 180°C TRGT | 180°C TRGT | 180°C TRGT | 180°C TRGT | 180°C TRGT | 180°C TRGT | 180°C TRGT |
| < 20°C | 190°C TRGT | 190°C TRGT | 190°C TRGT | 190°C TRGT | 190°C TRGT | 190°C TRGT | 190°C TRGT |

FIG. 3

| TIME | RISING SPEED | POWER SUPPLY RATIO |
|---|---|---|
| >100msec | <100°C/sec | 100% |
| 85~100msec | 100~118°C/sec | 90% |
| 70~85msec | 118~143°C/sec | 75% |
| <70msec | >143°C/sec | 60% |

(a)

| INITIAL THERMISTOR TEMP | PERIOD | TABLS |
|---|---|---|
| <40°C | 40~50°C | (b) |
| 40~50°C | 50~58°C | (c) |
| 50~70°C | 70~75°C | (d) |
| >70°C | NO | (e) |

(b)

| PERIOD | POWER SUPPLY RATIO |
|---|---|
| >100msec | 100% |
| 85~100msec | 90% |
| 70~85msec | 75% |
| <70msec | 60% |

(c)

| PERIOD | POWER SUPPLY RATIO |
|---|---|
| >100msec | 90% |
| 85~100msec | 75% |
| <85msec | 60% |

(d)

| PERIOD | POWER SUPPLY RATIO |
|---|---|
| >100msec | 75% |
| ≦100msec | 60% |

(e)

| INITIAL THERMISTOR TEMP | POWER SUPPLY RATIO |
|---|---|
| >70°C | 60% |

FIG. 9

| INITIAL THERMISTER TEMP | PERIOD | PWR SUPPLY RATIO |
|---|---|---|
| ≦70°C | 70~75°C | TBL (c) |
| >70°C | NO | 60% |

(c)

| PERIOD | PWR SUPPLY RATIO |
|---|---|
| >100msec | 100% |
| 85~100msec | 90% |
| 70~85msec | 75% |
| <70msec | 60% |

IMAGE FIXING APPARATUS

FIELD OF THE INVENTION AND RELATED ART

The present invention relates to a thermal fixing apparatus for heating an image formed on recording medium, which is used with an image forming apparatus such as an electrophotographic apparatus or electrostatic recording apparatus, in order to fix the image or improve its surface properties.

U.S. Pat. Nos. 5,149,941, and 5,262,834, for example, propose such an apparatus, which employs a fast response heating member and a piece of thin film.

An example of such a thermal heating apparatus is illustrated in FIG. 4.

The thermal heating apparatus in FIG. 4 basically comprises a heat resistant thin film 1 (or sheet), a driving means 11 for driving this film 1 (hereinafter, film driving means), a heater 6, and a pressing member 2. The heater 6 is fixedly mounted within the loop formed by the film 1, being in contact with the inward facing surface of the film 1. It is controlled to maintain a predetermined temperature. The pressing member 2 opposes the heater 6 from behind the film, firmly pressing the film onto the heater 6, so that the image bearing surface of the recording medium P, on which the image to be fixed is borne, is firmly pressed onto the heater 6, with the film 1 being interposed between the recording medium and heater 6. At least during the period when the image is actually fixed, the film 1 is driven at substantially the same speed, and in the same direction, as the recording medium P, which is introduced between the film 1 and pressing member 2 in order to fix the image on the recording medium P. While the recording medium P is conveyed, being pinched between the film 1 and pressing member 2 and compressed onto the heater 6, thermal energy is transmitted from the heater 6 to the visualized image (toner image to be fixed) through the film 1 which is moving with the recording medium P. The transmitted image softens and melts the image, fixing the image onto the recording medium P. After passing through the fixing section, the recording medium P is separated from the film P, at a predetermined separation point.

In the drawing, a reference numeral 12 designates a tension roller for applying tension to the film 1.

The temperature of the heater 6 is controlled by controlling the power supply to the heating element 5 of the heater 6, so that the heater temperature detected by a thermistor 4 remains constant.

The power supply may be controlled by such methods as a phase control, a wave number control, or the like. In the case of the wave number control, a control unit is composed of 14 waves of an AC voltage input. The amount of the input power is varied by means of changing the number of the waves applied to the heating element per control unit. The ON/OFF ratio is expressed as a duty ratio. It is variable within the range of 0% to 100%.

A film interposed heating system such as the one described above, can employ a heating member with extremely small thermal capacity, that is, a heating member with quick thermal response; therefore, it can greatly reduce the time necessary for the heater to reach a predetermined heating temperature. In addition, it can be easily heated from room temperature to a high temperature. Therefore, it does not need to be maintained at a standby temperature while the apparatus is on standby during non-printing periods, contributing to save electricity.

The film interposed type heating apparatus consumes an extremely small amount of electric power in comparison to a heat roller type heating apparatus, since it employs a low thermal capacity heater in order to heat a thin film. However, when the input voltage to the heat generating member varies, or when the resistance value of the heat generating member varies, the electricity consumption of the heat generating member varies; if the voltage is high, it consumes an excessive amount of electricity, limiting the environment in which it can be used. In most recent years, printers, facsimiles, and the like, which employ an electrophotographic system, have been showing a tendency to be widely used; it is being used not only in offices but also in average homes. In consideration of the power supply situation, the power consumption of the apparatus cannot be too low.

In a conventional apparatus, when the temperature of the heating member is maintained at a predetermined level, for example, at a fixing temperature, the aforementioned duty ratio is being varied through the PIC control or the like, in order to control the power consumption, that is, in order to adjust the power to an optimum value for maintaining the predetermined fixing temperature. However, when the apparatus is started up, that is, when the heater temperature is increased from room temperature to the fixing temperature to fix the first print, full power (duty ratio of 100%) is applied. This is due to the following reason. If the duty ratio for the start-up period is simply set low, it takes a long time to increase the duty ratio due to various restrictions; therefore, when sufficient voltage is not available, the heating apparatus may not be able to start up before the recording medium enters it. In other words, during the start-up period, it is unavoidable that the apparatus is greatly affected by the input voltage fluctuation. This can be compensated for by detecting the input voltage, and adjusting the power application duty ratio to the optimum value in response to the detected voltage, during the start-up period. However, such an arrangement leads to cost increase, and cannot solve the problems which occur due to the variance in the resistance value of the heat generating member. Therefore, it is not a preferable method.

Further, the power necessary for starting up the heating element is different from the power necessary for maintaining the fixing temperature. Therefore, immediately after the heating member reaches the fixing temperature, the duty ratio must be changed from the start-up duty ratio. When this change is made relying on the PID control alone, in which the duty ratio is switched in steps, it takes a longer time for the heating member temperature to stabilize at the target level, and also, it is likely that the amount of undershooting or overshooting may become larger.

Thus, a different method is employed, in which a proper value is assigned in advance to the duty ratio, to be used after the fixing temperature is reached. As soon as the heating member starts up, the duty ratio is switched to this value. However, even in the case of this method, when the duty ratio is simply set, it is affected by the input voltage fluctuation. Besides, the optimum value for the duty ratio also changes in response to the thermal condition of the apparatus. Therefore, immediately after the heating member is started up, temperature control is extremely difficult.

On the other hand, the film interposed heating system has an advantage in that it does not require temperature control while the heating member is on standby (hereinafter, standby temperature control). However, there is an extreme difference in fixing performance between when the first print is made immediately after printing is started while the apparatus temperature is the same as the room temperature (cold start), and when prints are made after printing is carried out for a certain length of time, and consequently, the pressure roller has been warmed up (post-paper passage printing). Therefore, generally, in order to equalize the fixing performances for both printing situations as closely as possible, the target temperature for the heating member is differentiated between the cold start situation and the post-paper passage printing situation; the target temperature for the cold start is set higher than the post-paper passage printing, so that under fixation, or off-set due to over fixation can be prevented. As for means for switching the target temperature as described above, a method has been known, in which the heating member temperature is detected immediately before actual printing begins, and the target temperature is set in response to the detected heating member temperature.

However, according to this method, the printing history of the apparatus up to the moment when printing begins is not taken into consideration. Therefore, whether printing is restarted after only one print is made starting from the cold condition, or after 12 prints are continuously made, the same target temperature is used for the first print when printing is restarted, as long as the heating member temperature for both situations are the same immediately before printing is restarted. Therefore, this method is not satisfactory for maintaining the heating member temperature at the proper level.

SUMMARY OF THE INVENTION

The present invention was made in view of the problems described above. Its primary object is to provide a fixing apparatus capable of stabilizing the power consumption of the heating member regardless of input voltage fluctuation.

Another object of the present invention is to provide a fixing apparatus capable of preventing the heating member from overshooting the target temperature when the heating member is started up.

Another object of the present invention is to provide a fixing apparatus capable of supplying the heating member with an optimum power, without a need for detecting the input voltage, during the warm-up and after the fixing temperature is reached.

A further object of the present invention is to provide a fixing apparatus capable of setting an optimum fixing temperature regardless of the condition in which the fixing apparatus is used.

According to an aspect of the present invention, a fixing apparatus comprises: a heat generating member which generates as power is applied thereto; a temperature detecting element for detecting the temperature of said heat generating member; power application control means for controlling the power to said heat generating member so that the temperature detected by said temperature detecting element maintains a fixing temperature; and power setting means for pre-applying power to said heat generating means in order to detect the rate of temperature change during this pre-application of power, before power is applied in order to start up said heat generating member to the fixing temperature, and setting the power which is to be applied during the start-up period, according to the detected rate of temperature change.

According to another aspect of the present invention, a fixing apparatus comprises: a heat generating member which generates as power is applied thereto; a temperature detecting element for detecting the temperature of said heat generating member; power application control means for controlling the power to said heat generating member so that the temperature detected by said temperature detecting element maintains a fixing temperature; and fixing temperature setting means for pre-applying power to said heat generating means in order to detect the rate of temperature change during this pre-application of power, before power is applied in order, to start up said heat generating member to the fixing temperature, and setting the fixing temperature, according to the detected rate of temperature change.

These and other objects, features and advantages of the present invention will become more apparent upon a consideration of the following description of the preferred embodiments of the present invention, taken in conjunction with the accompanying drawings.

BRIEF DESCRIPTION OF THE DRAWINGS

FIG. 1 is a control table for the first embodiment of the present invention.

FIG. 2 is a control table for the second embodiment of the present invention.

FIG. 3 is a control table for the third embodiment of the present invention.

FIG. 9 presents the control tables for Embodiment 5 of the present invention; (a) in a control table containing temperature ranges to be used for selecting an appropriate control table containing the power application ratio; (b), a control table for determining the power application ratio when the temperature climb rate measurement range is from 40° C. to 50° C.; (c), a control table for determining the power application ratio when the temperature climb rate measurement range is from 50° C. to 58° C.; (d), a control table for determining the power application ratio when the temperature climb rate measurement range is from 70° C. to 75° C.; and (e) is a control table for determining the power application ratio when the temperature detected by the thermistor is no less than 70° C.

FIG. 10(*b*), a control table containing temperature ranges to be used for selecting an appropriate control table containing the power application ratio; and FIG. 10(*c*) is a control table for determining the power application ratio according to the measured time.

DESCRIPTION OF THE PREFERRED EMBODIMENTS

Embodiment 1

Hereinafter, description will be given as to an electro-photographic printer employing the embodiment of the present invention, and the fixing apparatus thereof.

Figure 5:
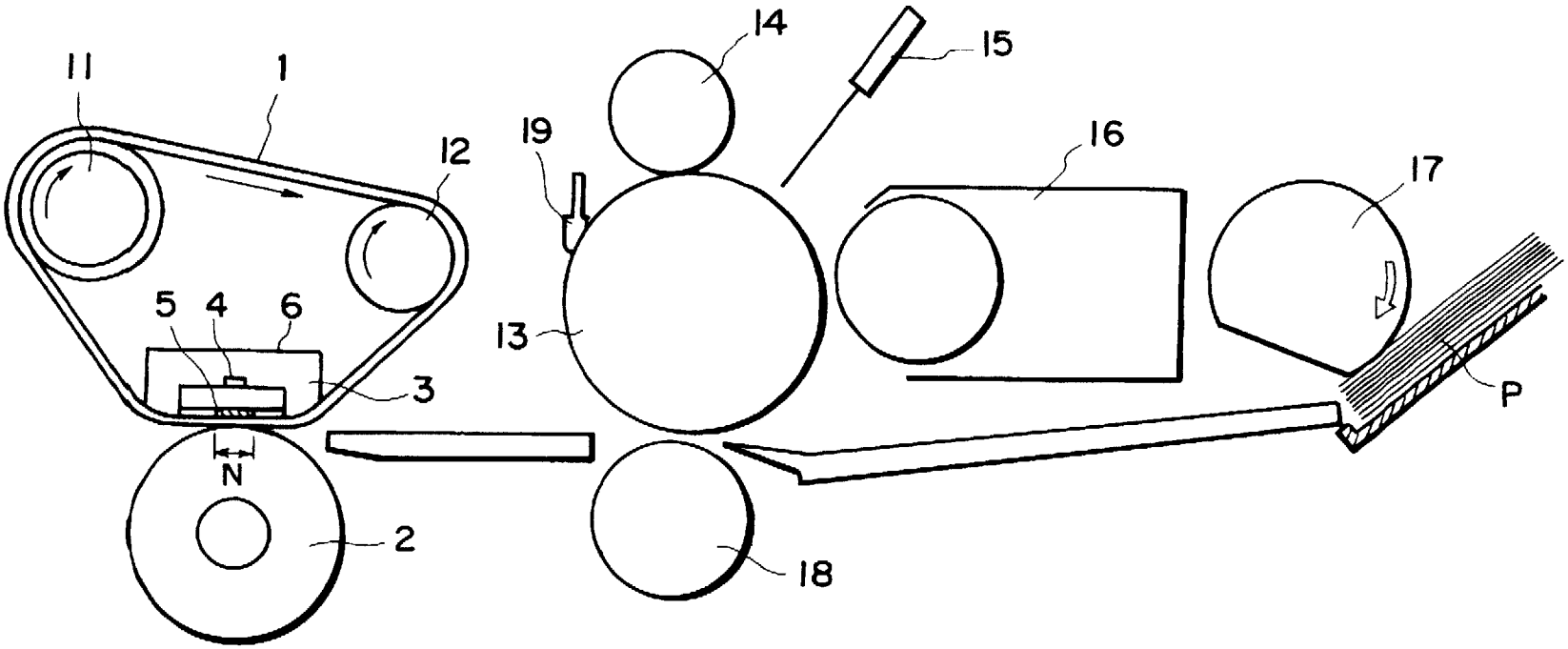
FIG. 5 is a schematic view of the structure of the electro-photographic printer employed in Embodiments 1–3.

The process speed of the printer is 25 mm/sec. Referring to FIG. 5, a photosensitive member 13 of OPC, the diameter of which is 30 mm, is uniformly charged to −650 V by a primary charger roller 14. The charged surface of the photosensitive member 13 is exposed to an image-signal-modulated laser beam emitted from a laser diode 15, whereby an electrostatic latent image is formed.

The electrostatic image is visualized as a toner image through the jumping development process, which uses a single component magnetic toner.

The toner image is transferred onto recording medium by a transfer roller 18 imparted with a bias voltage. The toner left behind without being transferred is removed by a urethane cleaning blade 19 placed in contact with the photosensitive drum, to prepare for the following image formation.

Figure 4:
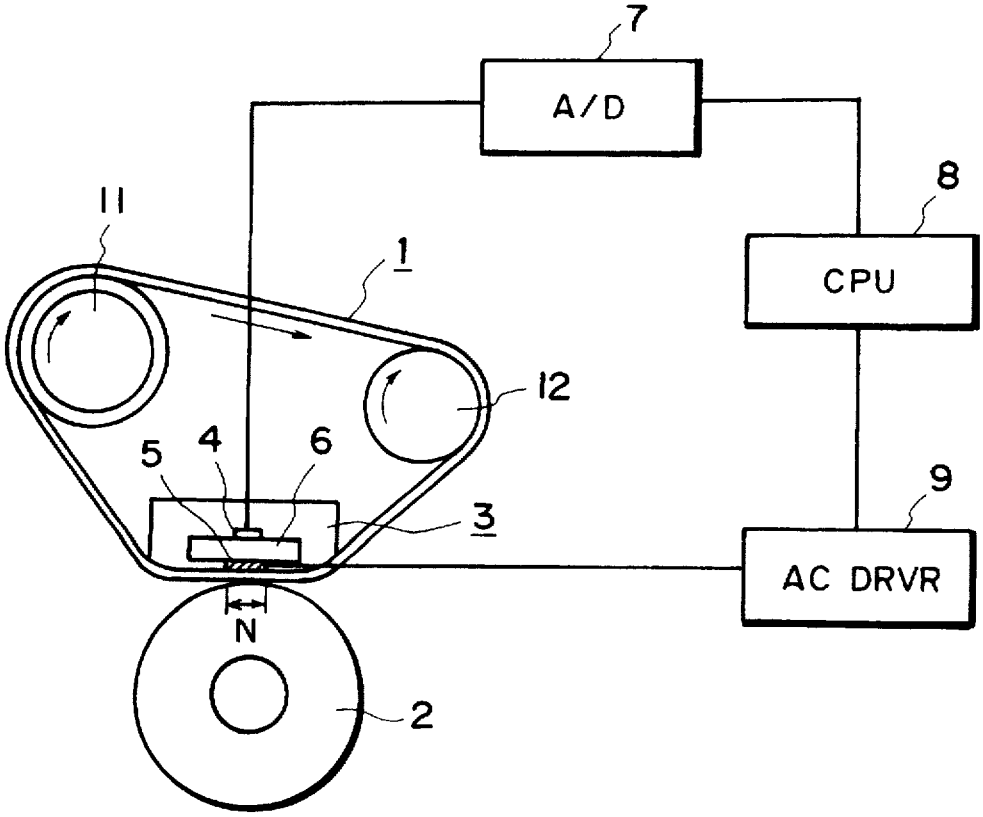
FIG. 4 PRIOR ART
FIG. 4 is a schematic view of a conventional heating apparatus.

The recording medium, which has received the transferred toner image, is conveyed to a fixing apparatus, in which the toner image is fixed to the recording medium. The recording medium, onto which the toner image has been fixed, is discharged from the apparatus. The basic structure of this thermal fixing apparatus is the some as the one illustrated in FIG. 4; therefore, the detailed description thereof will be omitted.

The heater 6 is disposed substantially perpendicular to the direction in which the film is moved. It is constituted of a 1 mm thick ceramic with preferable thermal conductivity, and a heat generating resistor 5 with a resistance value of 34 Ω. The heat generating resistor 5 is disposed on the bottom surface of the ceramic. On the top surface of the ceramic, a thermistor 4, which is a temperature detecting element, is disposed. The output signal of the thermistor 4 is inputted to a CPU through an A/D converter. The CPU controls the power to be applied to the heat generating resistor 5, through an AC driver 9, on the basis of this input signal, so that the surface temperature of the heater is maintained at a predetermined level. In controlling the power applied to the heater 6, a control unit is composed of 14 waves of the AC input voltage, and the input power is varied changing how many waves out of the control unit is applied to the heater 6; so-called wave number control is employed. Therefore, the ratio of the ON state to the OFF state is expressed as duty ratio. In the case of this embodiment, the duty ratio is varied between 0% and 100% in 15 steps, each step representing approximately 7.14%. Needless to say, the number of waves in the control unit is not limited to 14 waves. For example, it may comprise 20 waves; in other words, the duty ratio may be changed by an interval of 5%.

Since the fixing apparatus in this embodiment has an extremely low thermal capacity, the power to the heat generating member 5 is turned off while the printer is on standby, waiting for the print signal. Then, after the print signal is inputted to the printer, the power to the heating member 5 is resumed to increase the temperature of the heater 6 to the fixing temperature.

Since the heater must be started up so that it reaches the fixing temperature before the recording medium enters the fixing apparatus, the power, which is supplied to the heater while the heater is started up from room temperature to the fixing temperature, is larger than the power necessary for maintaining the heater temperature at the fixing temperature. Therefore, the maximum power consumption of the heater occurs during the start-up period. When the input voltage increases beyond an optimum value, an extremely large amount of power is consumed when the input voltage is highest, allowing an unnecessarily large amount of current to flow. Further, when the power supplied to the heater during the start-up period is large, the heater is started up too quickly, and as a result, the amount of the overshooting also increases. Thus, in this embodiment, before power is supplied to the heating member to start it up to the fixing temperature, preferably, before the sheet of recording medium begins to be fed out of a sheet feeder cassette, power is pre-applied to the heater for a predetermined duration in order to detect the rate of temperature increase during this period, and the detected rate is used for determining an appropriate power application ratio. In other words, the thermal condition of the apparatus, and the condition of the input voltage, can be examined to a certain degree by means of pre-applying power to the heater for a predetermined length of time before the beginning of the actual printing operation. It should be noted here that the object of the present invention is to stabilize the power consumed during the start-up period of the heater, without relying on the input voltage. For example, when the heater temperature is at room temperature, the rate of temperature increase becomes higher in proportion to the input voltage; if an input voltage of 130 V is supplied, the power consumption at full power is 497 W. This power consumption can be reduced to approximately 200 W simply by means of setting the power application duty ratio at approximately 40% during the warmup period. In this case, 200 W is an arbitrary power necessary for starting up the heater from room temperature to the fixing temperature before the recording medium enters the fixing apparatus. Needless to say, this value is unlimitedly changeable depending on the apparatus structure. Further, when the apparatus is already warm, and the heater can be started up using a power smaller than 200 W, it is unnecessary to stick to this arbitrary value.

A specific method for determining the power application ratio is as follows. After the reception of a print signal from a host computer, power is supplied to the heater 6 for a duration of 0.6 sec before feeding the sheet (in this embodiment, before the recording medium enters the nip formed between the heater and pressure roller), and the rate of temperature increase during this period is detected. Then, the power application ratio to be used during the start-up period is determined on the basis of the detected rate of temperature increase, the heater temperature before the pre-application of power, and the control table given in FIG. 1. In this case, the heater temperature may be simply measured before power is pre-applied to detect the rate of temperature increase, after the print signal is inputted. The reason for referring to the pre-power application heater temperature is that an appropriate amount of power necessary to start up the heater to a targeted fixing temperature within a predetermined duration of time can be estimated from the difference between the pre-power application heater temperature and the targeted fixing temperature. However, there is an additional reason that referring to the pre-power application heater temperature makes it possible to know whether the apparatus is cold, or warm after printing several prints. In this embodiment, the duration of the pre-application of power before sheet feeding is set at 0.5 sec. but this also may be optionally set at any number of seconds, depending on the apparatus structure, temperature increase detection efficiency, and the like. Further, when it is immediately after the printer has finished the preceding printing operation, and the heater temperature is substantially high, the power application ratio for the start-up period of the heater, may be simply set low without pre-applying power before sheet feeding.

Further, the rate of temperature increase can be detected without applying power to the heating member at a duty ratio of 100%; for example, it can be detected using a duty ratio of 50%. In other words, any duty ratio between 1% and 100% may be used. In particular, when the amount of power consumed at full power is large, it is effective to reduce the duty ratio.

As is evident from the description given above, it is possible to control the power consumption of the apparatus during the warmup period by adopting the structure of this embodiment, so that the power consumption becomes just right.

Embodiment 2

In this embodiment, power is pre-applied to the heat generating member for a predetermined period of time before power begins to be supplied to the heating member to start up the heat generating member to the fixing temperature, preferably, before the sheet begins to be fed, and the rate of temperature increase during this period is used to determine the power application ratio for supplying power to the heater immediately after the heater is started up to the fixing temperature. The fixing apparatus in this embodiment has an extremely low thermal capacity; therefore, if power supply to the heater is turned off immediately after the heater reaches the fixing temperature, the heater temperature quickly drops. Thus, power is supplied to the heat generating member even after the heater temperature reaches the fixing temperature. As described above, the power application duty ratio is switched after the heater reaches the fixing temperature. When the value of the duty ratio immediately after switching is not an appropriate one, the amount of overshooting or undershooting increases. In other words, the proper value for the duty ratio to be used immediately after switching is dependent on the input voltage to the apparatus and the thermal condition of the apparatus before the start-up of the apparatus. Thus, in this embodiment, the condition of the input voltage to the apparatus, and how warm the apparatus is, are examined by pre-applying power to the heater before the apparatus is actually started up, and the duty ratio to be employed immediately after switching is determined on the basis of the results of the examination.

More specifically, after a print signal is inputted, the heater temperature is detected before power application, and then, full power is supplied to the heating apparatus for a duration of 0.5 second before the printer begins reading the sheet. In this period, in which the roller and film of the heating apparatus are not rotated, the rate of temperature increase is detected. Then, the power application rate to be employed immediately after the start-up of the heater is determined from these two parameters and the control table given in FIG. 2. In this embodiment, the wave number control based on a control unit of 14 waves is used as it is in Embodiment 1, but other power control method such as the phase control may be used, which also applies to Embodiment 1.

As soon as the heater temperature reaches the fixing temperature after the printer begins to feed the sheet of recording medium, power begins to be supplied to the heater. In this embodiment, however, the amount of power, supplied to the heater is proper; therefore, there will be no overshooting or undershooting; if there is any, it will be extremely small. Thereafter, the amount of power to be supplied to the heater is automatically switched by the PID control or the like, to maintain the heater temperature at the fixing temperature.

The rate of temperature increase can be more accurately detected when the power for determining the power application duty ratio is applied for the duration of 0.5 second while the rotational components of the heating apparatus are not driven, than while they are driven, but the rate of temperature increase may be detected while the rotational components are driven, as long as it is detected before the recording medium enters the nip. It should be noted here that this embodiment and Embodiment 1 can be employed in combination. That is, after power is pre-applied to the heat generating member for 0.5 second, the heater may be started up using the table in FIG. 1, and the power to be supplied immediately after the start-up may be controlled using the control table in FIG. 2. Further, the power application ratio may be switched from the rate for starting up the heater to the rate for maintaining the fixing temperature, when the heater temperature is slightly below the fixing temperature. Such switching is made in anticipation of slight overshooting.

As described above, the amount of overshooting or undershooting can be reduced by means of pre-applying power to the heater for a predetermined length of time before the sheet begins to be fed after a print signal is inputted, and determining the power application duty ratio to be applied immediately after the heater is started up, on the basis of the rate of temperature increase detected during this period.

In Embodiments 1 and 2, the control tables are constituted of a matrix containing the pre-power application heater temperature and the power application duty ratio. However, the heater temperature can be effectively controlled to a certain extent, on the basis of the rate of the heater temperature increase alone, which is needless to say.

Embodiment 3

Also in this embodiment, power is pre-applied to the heater for a duration of 0.5 second before the sheet is fed, as it is Embodiments 1 and 2, and the thermal condition (how warm the heater is) is assessed on the basis of the rate of the heater temperature increase detected during this period, and the heater temperature detected before the pre-application of power. Then, the fixing temperature for the first print is determined according to the assessed thermal condition of the heating apparatus, and the control table given in FIG. 3. According to this control table, the fixing temperature for the first print can be selected from four temperatures: 160° C., 170° C., 180° C. and 190° C. In the case of a conventional apparatus, the determination of the fixing temperature for the first print is dependent upon only the temperature detected before printing is started; therefore, when printing is restarted after a certain number of sheets are passed through the heating apparatus, it is difficult to know the thermal condition of the heating apparatus, though it is possible to know whether current printing starts from a cold or warm condition. In this embodiment, the rate of the heater temperature increase as well as the thermal condition of the heating apparatus before printing is detected; therefore, the condition of the heating apparatus can be more accurately known than in the case of the conventional apparatus. As a result, the fixing temperature can be more accurately controlled to produce a preferable image with no sign of offset or insufficient fixation.

In the cases of the embodiments described to this point, the rate of the heater temperature increase is measured by pre-applying power to the heat generating member for a predetermined length of time, but it may be calculated by detecting the time necessary for the heater temperature to increase a predetermined number of degrees.

Also in the cases of the embodiments described above, the rate of the heater temperature increase is measured while the heater is started up to the fixing temperature, and after the measurement, the power to be applied until the fixing temperature is reached is set according to the measured rate of the heater temperature increase.

Figure 6:
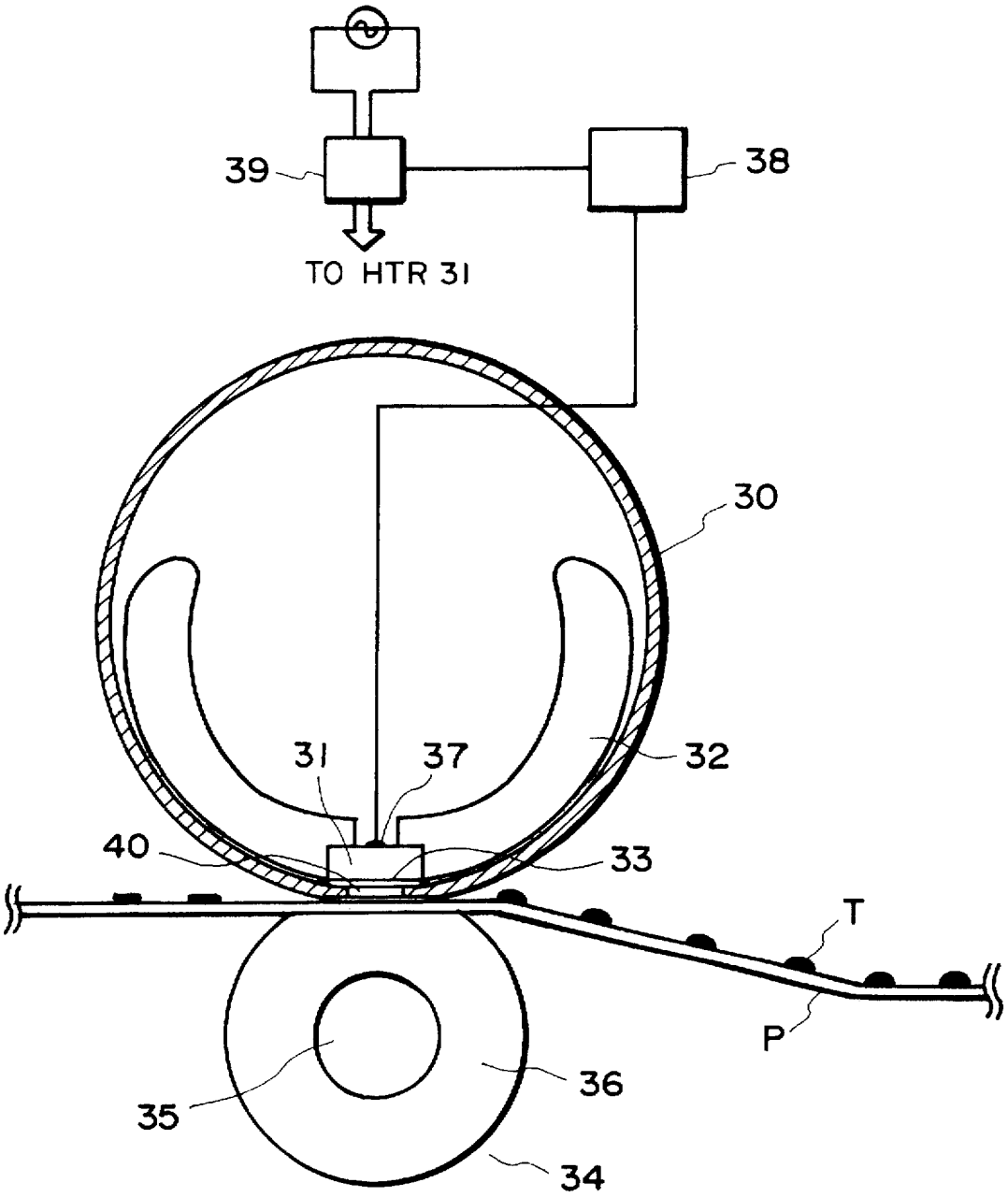
FIG. 6 is a sectional view of the heating apparatus employed in Embodiments 4–6.

The fourth embodiment of the present invention will be described with reference to FIGS. 6 and 7. FIG. 6 is a sectional view of an embodiment of the image heating apparatus in accordance with the present invention.

In FIG. 6, a reference numeral 30 designates an endless piece of heat resistant film. It is fitted around a stay in which a heating member 31 is imbedded. The internal circumference of this endless heat resistant film 30 is rendered longer by approximately 3 mm, for example, than the external circumference of the stay 32. Therefore, the film 30 loosely fits around the stay 32, with a sufficient margin.

In order to improve the quick-start properties of the heating apparatus by reducing the thermal capacity of the film 30, the thickness of the film 30 is made to be no more than 100 μm, preferably, no more than 50 μm and no less than 20 μm. As for the material for the film 30, it is possible to use single layer film or compound layer film. The single layer film is generally made of PTFE, PFA, or FEP, and the compound layer film is composed of a base film layer of polyimide, polyamide-imide, PEEK, PES, or PPS, and a surface layer of PTFE, PFA, or FEP, which are coated on the outward facing side of the base film. In this embodiment, a compound film composed of a base film of polyimide, and a surface layer of PTFE coated on the outward facing side of the base film is used.

The heating member (hereinafter, heater) 31 comprises a substrate, a heat generating member 33, and a protective layer 40. The substrate is made of alumina or the like. The heat generating member 33 is constituted of approximately 10 μm thick, 1–3 mm wide electrically resistant material, such as Ag/Pd or the like, coated on the substrate by the screen printing or the like. The protective layer is glass, fluoro-resin, or the like, coating the heat generating member 33.

Onto this heating member 31, a pressure roller 34 is pressed, forming a nip, with the film 30 being interposed. The pressure roller 34 is constituted of a core metal 35 and a surface layer of heat resistant rubber material with separative properties, such as silicone rubber, and is driven by driving means (unillustrated) by way of the end portion of the core metal 35. As the pressure roller 34 is driven, the film 30 is driven by the rotation of the roller 34.

The temperature control for the apparatus in the embodiments of the present invention is executed in the following manner. The output of a thermistor 37, which is disposed on the heater 31 and serves as temperature detecting means, is digitized and inputted to a CPU 38, that is, temperature controlling means. Based on the inputted data from the thermistor, the CPU 38 commands the heater temperature to be maintained at a target level, by regulating the AC voltage applied to the heater 31 through a TRIAC 39, using the phase control, the wave number control, or the like. More specifically, when the temperature detected by the thermistor 37 is lower than a predetermined level, the CPU 38 regulates the power supply to the heater 31 so that the heater temperature increases, and when higher, it regulates the power supply so that the heater temperature decreases. Thus, the heater temperature is stabilized during the fixing operation.

As the recording medium P carrying an unfixed image composed of toner powder is conveyed into the nip formed between the heater 31 and pressure roller 34, with the film 30 being interposed, the unfixed image composed of toner powder is malted and fixed onto the recording medium P as heat and pressure are applied in the nip.

As described above, the image heating apparatus in this embodiment can be used as a fixing apparatus for an image forming apparatus such as a copying machine or printer. In this image heating apparatus, as the main switch of the image forming apparatus is turned on, the power to the heater 31 is turned on after a print command is received. During a standby period, that is, while waiting for the print command, the power to the heater 31 is interrupted.

Therefore, the apparatus temperature remains at room temperature level (cold) during the standby period, which causes the following problem. When a printing operation is started from this cold state, a large amount of rush current flows during the start-up period of the heater 31, and it may exceed the capacity of the power supply circuit as the power source voltage reaches a predetermined maximum value.

Figure 7:
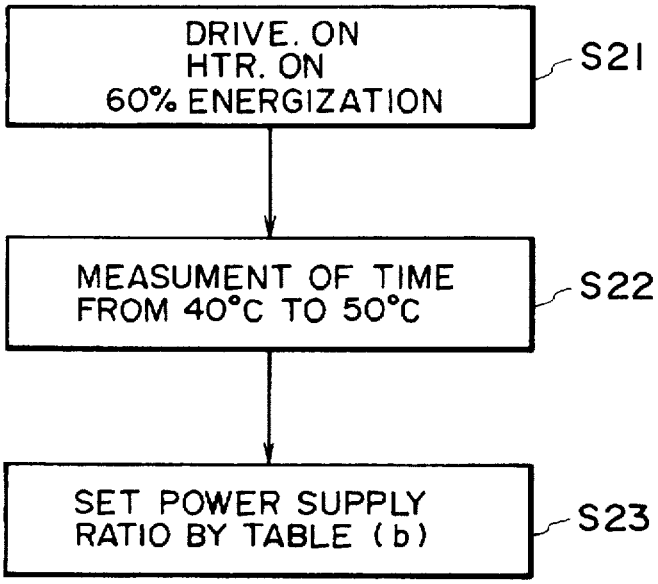
FIG. 7(*a*) is a flow chart of a method for determining the power application ratio in Embodiment 4 of the present invention, and FIG. 7(*b*) is a control table therefor.

Therefore, in this embodiment, a measure illustrated in FIG. 7(*a*) is taken. That is, in order to prevent the rush current from exceeding the power supply circuit capacity even when the power source voltage exceeds the predetermined maximum value, the power supply to the heater 31 is controlled in such a manner that the initial power application ratio for the heater 31, which is used immediately after a print command is inputted, is set at 60% (step 821). The power supply may be controlled using either the phase control or wave number control. In this embodiment, the wave number control is employed.

During this step, when the power source voltage is low, the climbing speed of the heater temperature is slow, and contrarily, when the power source voltage is high, the climbing speed is faster. Therefore, in this embodiment, the time necessary for the temperature of the heater 31 to climb from 40° C. to 50° C. is measured (step S22), and the power source voltage is estimated from the detected climbing speed of the heater temperature. Then, the power application ratio for the heater 31 is changed according to the estimated voltage value, whereby the voltage applied to the heater 31 can be controlled so that neither too much nor too little amount of voltage can be applied to the heater 31, within the capacity limit of the power supply circuit, regardless of the power source voltage level. More specifically, a table given in FIG. 7(*b*), which contains the power application ratio in relation to the measured time, is stored in the CPU 38 in advance. Then, the power application ratio is obtained from the time necessary for the heater temperature to climb, which is measured as described above, and the stored table, and the power application ratio used during the warmup period is set at the obtained level (step S23).

As described above, according to this embodiment, the power supply to the heater can be controlled so that a proper amount of power, being proportional to the power source voltage fluctuation, is supplied to the heater, without the need for a voltage detection circuit. As a result, neither braker activation nor insufficient fixation occurs.

Embodiment 5

Next, the fifth embodiment of the present invention will be described with reference to FIGS. 8 and 9. The sections common to the fourth and fifth embodiments are given the same referential symbol, and their description will be omitted.

Figure 8:
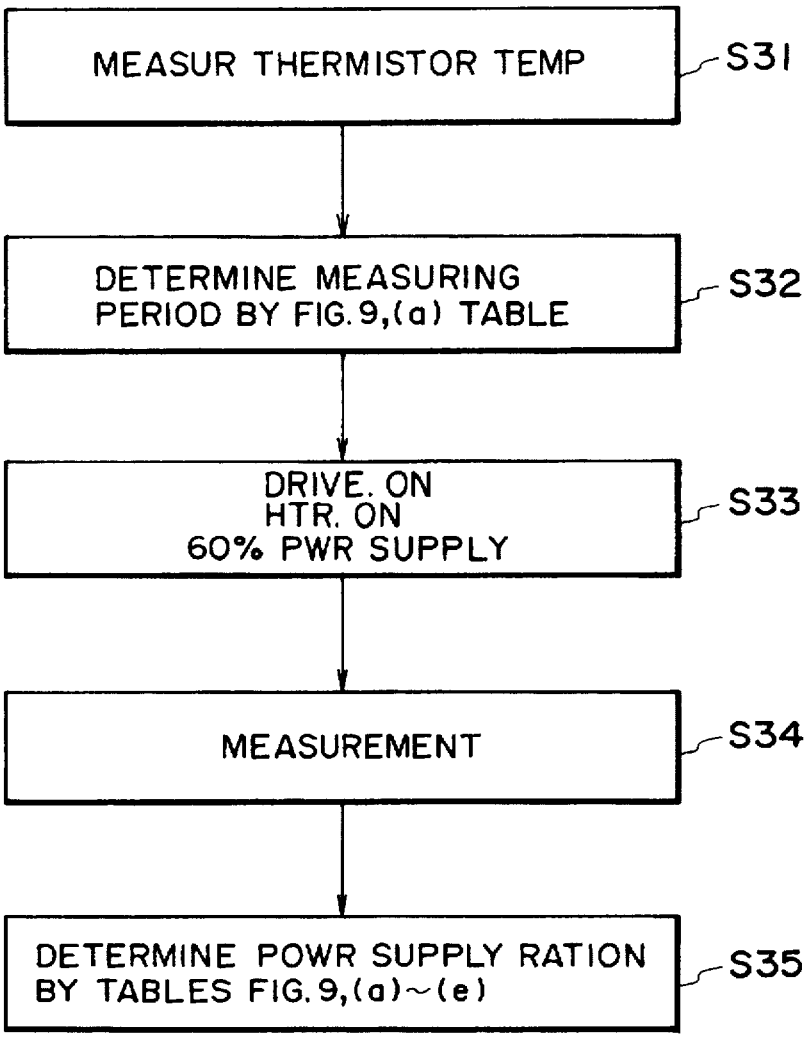
FIG. 8 is a flow chart of a method for determining the power application ratio in Embodiment 5 of the present invention.

FIG. 8 is a flow chart of a method for determining the power application ratio in this embodiment. As is shown in FIG. 8, before power begins to be supplied to the heater 31 in order to start up the heater 31 to the fixing temperature, the heater temperature is obtained from the value of the thermistor 37 (step S31), and the obtained temperature is used to select a temperature range, in which rate of temperature increase is measured, from the table given in FIG. 9(*a*) (step S32).

Then, as a print command is received, power is turned on with the power application ratio for the heater 31 being set at 60% (step S33), and the time necessary for the heater temperature to climb through the temperature range selected from the aforementioned table is measured.

However, when the temperature detected by the thermistor is no less than 70° C. before power is pre-applied to the heater, the fixing apparatus is considered to have warmed up sufficiently; therefore, the climbing time of the heater temperature is not measured (step S34).

After measuring the climbing time of the heater temperature as described above, the power application ratio for the warmup period is set up by referring to the table in FIG. 9(*a*), first, to select the temperature range to be used, and next, referring to one of the tables FIGS. 9(*b*), 9(*c*), 9(*d*) and 9(*e*) (step S35).

For example, when the temperature, which is initially detected by the thermistor, is no more than 40° C., the temperature range 40° C.–50° C. is selected. Then, if the climbing time falls between 85 msec and 100 msec, a power application ratio of 90% is selected from the table in FIG. 9(*b*).

On the other hand, when the temperature, which is initially detected by the thermistor, is no less than 70° C., the climb time is not measured, and the power application ratio is set at 60%, which is the same value as the initially set value, using the table in FIG. 9(*e*).

As described above, this embodiment enjoys merits in that, when the fixing apparatus is cold, precise control is executed, and when the fixing apparatus is warm, wasteful computation is unnecessary.

Embodiment 6

Next, the sixth embodiment of the present invention will be described with reference to FIG. 10. The section common to the fourth and sixth embodiments will be given the same referential symbol, and their description will be omitted.

Figure 10:
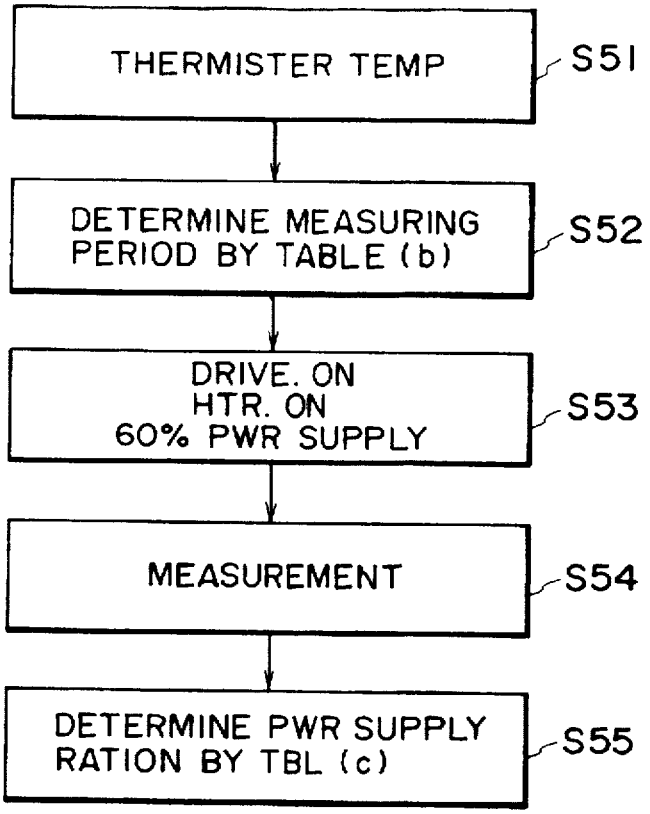
FIG. 10(*a*) is a flow chart for determining the power application ratio in Embodiment 6 of the present invention.

FIG. 10(*a*) is a flow chart of a method for determining the power application ratio in this embodiment. Referring to FIG. 10(*a*), the heater temperature is measured by the thermistor (step S51). When the temperature of the heater 31 is no more than 70° C., a climbing time measurement temperature range 70°–75° C. is selected from the table in FIG. 10(*b*), whereas when the heater temperature is no less than 70° C., the climbing time is not measured (step S52). Then, pre-application of power is started with the power application ratio set at an initial value of 60% (step S53), and the climbing time of the temperature within the selected temperature range is measured (step S54). Next, power application ratio is determined using the table in FIG. 10(*c*). When the initial heater temperature is no less than 70° C., and therefore, the climbing time of the heater temperature is not measured, power application ratio is left at 60%.

According to this embodiment, only two tables need to be prepared: one for when the heater temperature, which is detected by the thermistor before the pre-application of power to the heater, is no less than 70° C., and the other for when it is no more than 70° C. Therefore, the program can be short.

Also in this embodiment, the power application ratio to be used for pre-applying power to the heater is set at 60%, but the ratio is not limited to this ratio.

In the descriptions of the embodiments, the fixing apparatus comprising a film is referred to, but it should be evident that the present invention is applicable to a fixing apparatus employing the roller type system.

While the invention has been described with reference to the structures disclosed herein, it is not confined to the details set forth, and this application is intended to cover such modifications or changes as may come within the purposes of the improvements or the scope of the following claims.

What is claimed is:

1. A fixing apparatus comprising:

a heat generating element for generating heat upon electric power supply thereto;

a temperature detecting element for detecting a temperature of said heat generating element;

power application control means for controlling the power to said heat generating element so that the temperature detected by said temperature detecting element maintains a fixing temperature; and power setting means for pre-applying power to said heat generating element to detect a rate of temperature rise during the pre-application of power, before power is applied to start up said heat generating element to the fixing temperature, and for setting the power to be applied during the start-up period, in accordance with the detected rate of temperature rise.

2. A fixing apparatus according to claim 1, wherein said power setting means sets the power, which is to be applied until the detected temperature reaches the fixing temperature after power application begins.

3. A fixing apparatus according to claim 1, wherein said power setting means sets the power, which is to be applied after the detected temperature reaches the fixing temperature.

4. A fixing apparatus according to claim 1, wherein said apparatus is used in an image forming apparatus which forms an image on recording medium, and power is pre-applied to obtain the rate of temperature rise, after a print signal is inputted to said image forming apparatus.

5. A fixing apparatus according to claim 4, wherein power is pre-applied to obtain the rate of temperature rise, before recording medium is fed.

6. A fixing apparatus according to claim 1, further comprising a film movable in contact with said heat generating member, wherein an unfixed image carried on the recording medium is heated by said heat generating element through said film.

* * * * *

UNITED STATES PATENT AND TRADEMARK OFFICE

CERTIFICATE OF CORRECTION

PATENT NO. : 5,801,360

DATED : September 1, 1998

INVENTORS : HIROYUKI OBA, ET AL.

It is certified that error appears in the above-identified patent and that said Letters Patent is hereby corrected as shown below:

COLUMN [57] ABSTRACT,
Line 4, "power" should read --a power--.

COLUMN S10,
Figure 10(a), "THERMISTER" should read --THERMISTOR--; and
Figure 10(b), "THERMISTER" should read --THERMISTOR--.

COLUMN 4,
Line 39, "in" should read --is--.

COLUMN 5,
Line 20, "some" should read --same--.

COLUMN 7,
Line 42, "reading" should read --feeding--.

COLUMN 9,
Line 1, "¶ The" should read --Embodiment 4. ¶ The--.

UNITED STATES PATENT AND TRADEMARK OFFICE

CERTIFICATE OF CORRECTION

PATENT NO. : 5,801,360

DATED : September 1, 1998

INVENTORS : HIROYUKI OBA, ET AL.

It is certified that error appears in the above-identified patent and that said Letters Patent is hereby corrected as shown below:

COLUMN 10,
Line 20, "821)." should read --S21).--.

Signed and Sealed this

Twenty-seventh Day of July, 1999

*Attest:*

Q. TODD DICKINSON

*Attesting Officer*

*Acting Commissioner of Patents and Trademarks*